US011519189B2

(12) United States Patent
Leonard

(10) Patent No.: US 11,519,189 B2
(45) Date of Patent: Dec. 6, 2022

(54) BRACKET AND ADJUSTABLE STRUCTURES FOR LEVELING A BUILDING

(71) Applicant: TILSON HOME CORPORATION, Houston, TX (US)

(72) Inventor: Gene Leonard, Fredericksburg, TX (US)

(73) Assignee: TILSON HOME CORPORATION, Houston, TX (US)

( * ) Notice: Subject to any disclaimer, the term of this patent is extended or adjusted under 35 U.S.C. 154(b) by 29 days.

(21) Appl. No.: 17/159,461

(22) Filed: Jan. 27, 2021

(65) Prior Publication Data

US 2022/0235566 A1 Jul. 28, 2022

(51) Int. Cl.

| | |
|---|---|
| ***E04G 21/18*** | (2006.01) |
| ***E04B 1/36*** | (2006.01) |
| ***E04B 1/41*** | (2006.01) |
| ***E04B 1/38*** | (2006.01) |

(52) U.S. Cl.

CPC ..... *E04G 21/185* (2013.01); *E04B 1/36* (2013.01); *E04B 1/4157* (2013.01); *E04B 2001/405* (2013.01)

(58) Field of Classification Search

CPC ..... E04G 21/185; E04B 1/36; E04B 1/4157; E04B 2001/405

See application file for complete search history.

(56) References Cited

U.S. PATENT DOCUMENTS

| | | | | |
|---|---|---|---|---|
| 6,311,449 | B1 * | 11/2001 | Morse | E04B 1/003 52/289 |
| 8,037,651 | B2 * | 10/2011 | Dent | E02D 27/32 52/297 |
| 8,336,267 | B2 * | 12/2012 | Montague | E04B 1/4157 52/295 |
| 8,443,517 | B2 * | 5/2013 | Curtis | E04B 1/41 29/897 |
| 9,297,161 | B2 * | 3/2016 | Zimmerman | E04B 7/045 |
| 9,932,735 | B1 * | 4/2018 | Biasucci | E04B 1/2612 |
| 10,352,035 | B1 * | 7/2019 | Boor | E04B 7/024 |
| 2009/0272053 | A1 * | 11/2009 | Dent | E04H 12/2261 52/699 |
| 2010/0107545 | A1 * | 5/2010 | Montague | E04B 1/4157 52/745.19 |
| 2012/0177435 | A1 * | 7/2012 | Curtis | E01C 11/02 29/525.01 |
| 2013/0067851 | A1 * | 3/2013 | Zimmerman | E04B 1/2608 52/707 |
| 2018/0298603 | A1 * | 10/2018 | Preece | E04B 1/40 |

* cited by examiner

*Primary Examiner* — Rodney Mintz

(74) *Attorney, Agent, or Firm* — Jeffrey Streets; Madan Law PLLC

(57) ABSTRACT

A bracket forms one or more U-channel for receiving a beam that supports a portion of a building. An adjustable structure for supporting a beam includes the bracket and a concrete footer or pier having an anchor bolt, wherein the anchor bolt has one end securely embedded within the concrete and threaded end extending upward from the concrete. A leveling nut is threaded onto the anchor bolt below a base plate of the bracket, a top nut is threaded onto the second end of the anchor bolt above the base plate, and a block is disposed between the concrete footer or pier and the base plate to support the weight of the beam. The adjustable structure enables a person to adjust the elevation of an identified portion of a building that is not level.

20 Claims, 9 Drawing Sheets

BRACKET AND ADJUSTABLE STRUCTURES FOR LEVELING A BUILDING

BACKGROUND

The present disclosure relates to a method and apparatus for leveling a building during construction or any time after construction or occupancy of the building.

BACKGROUND OF THE RELATED ART

Some buildings are constructed on a pier and beam foundation. Concrete footers and/or piers are embedded in the soil and extend upward to support a number of beams every few feet along the length of each beam. The building is then constructed on the beams which support the building above the ground. A crawl space is created under the building allowing access to the beams and other utilities run under the building. Pier and beam foundations may be used in both residential and commercial buildings. For example, a residential home may be built with a pier and beam foundation.

BRIEF SUMMARY

Some embodiments provide a bracket comprising a base plate, first and second upstanding plates integrally formed with the base plate and extending perpendicular to the base plate, a first gusset plate formed between the base plate and an outward-facing surface of the first upstanding plate, and a first hole in the base plate adjacent the first gusset plate, wherein the first gusset plate is perpendicular to both the base plate and the first upstanding plate, and wherein the first upstanding plate is parallel to the second upstanding plate. A U-channel is formed by an inward-facing surface of the first upstanding plate, an inward-facing surface of the second upstanding plate, and an upward facing surface of the base plate, wherein the U-channel has and first and second open ends and an open top opposite the upward facing surface of the base plate, and wherein the U-channel has a uniform width that is sized to receive a structural beam supported on the upward facing surface of the base plate and flush between the inward-facing surfaces of the first and second upstanding plates.

Some embodiments provide a bracket comprising a base plate, first and second upstanding plates integrally formed with the base plate and extending perpendicular to the base plate, as well as third and fourth upstanding plates integrally formed with the base plate and extending perpendicular to the base plate. The first upstanding plate is parallel to the second upstanding plate, wherein a first U-channel is formed by an inward-facing surface of the first upstanding plate, an inward-facing surface of the second upstanding plate, and an upward facing surface of the base plate, wherein the first U-channel has first and second open ends and an open top opposite the upward facing surface of the base plate, and wherein the first U-channel has a uniform width that is sized to receive a first structural beam supported on the upward facing surface of the base plate and flush between the inward-facing surfaces of the first and second upstanding plates. The third upstanding plate is parallel to the fourth upstanding plate, wherein a second U-channel is formed by an inward-facing surface of the third upstanding plate, an inward-facing surface of the fourth upstanding plate, and the upward facing surface of the base plate, wherein the second U-channel has an open top opposite the upward facing surface of the base plate and first and second open ends, and wherein the second U-channel has a uniform width that is sized to receive a second structural beam supported on the upward facing surface of the base plate and flush between the inward-facing surfaces of the third and fourth upstanding plates. The bracket further comprises a first hole in the base plate between the first U-channel and the second U-channel.

Some embodiments provide a structure for supporting a beam comprising a concrete footer or pier, and an anchor bolt having a first end securely embedded within the concrete footer or pier and a second end extending upward from the concrete footer or pier, wherein the second end has threads for coupling with a leveling nut and a top nut. The structure further comprises a bracket according to one of the disclosed embodiments of a bracket. For example, the bracket may comprise a base plate, and first and second upstanding plates integrally formed with the base plate and extending perpendicular to the base plate, wherein the first upstanding plate is parallel to the second upstanding plate, wherein a U-channel is formed by an inward-facing surface of the first upstanding plate, an inward-facing surface of the second upstanding plate, and an upward facing surface of the base plate, wherein the U-channel has an open top opposite the upward facing surface of the base plate and first and second open ends, and wherein the U-channel has a uniform width that is sized to receive a structural beam supported on the upward facing surface of the base plate and flush between the inward-facing surfaces of the first and second upstanding plates. The bracket may further comprise a first gusset plate formed between the base plate and an outward-facing surface of the first upstanding plate, wherein the first gusset plate is perpendicular to both the base plate and the first upstanding plate. A first hole may be disposed in the base plate outside the U-channel and adjacent the first gusset plate, wherein the second end of the anchor bolt extends through the first hole in the base plate, and wherein the leveling nut is threaded onto the second end of the anchor bolt below the base plate and the top nut is threaded onto the second end of the anchor bolt above the base plate. The structure may also comprise a block disposed between the concrete footer or pier and the base plate, wherein the block is positioned in contact with the base plate directly under the U-channel.

Some embodiments provide a building comprising a concrete structure including one or more footer and one or more pier. A plurality of anchor bolts extend from the concrete structure, where each anchor bolt has a first end securely embedded within the concrete structure and a second end extending upward from the concrete structure, wherein the second end has threads for coupling with a leveling nut and a top nut. The building further comprises a plurality of brackets, each bracket being coupled to one or more of the anchor bolts, and a plurality of beams, each beam being secured by two or more of the brackets. A floor, walls and a roof are supported by the plurality of beams. The plurality of brackets may include brackets selected from any one or more of the disclosed embodiments of a bracket. For example, the bracket may comprise a base plate, and first and second upstanding plates integrally formed with the base plate and extending perpendicular to the base plate, wherein the first upstanding plate is parallel to the second upstanding plate, wherein a U-channel is formed by an inward-facing surface of the first upstanding plate, an inward-facing surface of the second upstanding plate, and an upward facing surface of the base plate, wherein the U-channel has an open top opposite the upward facing surface of the base plate and first and second open ends, and wherein the U-channel has a uniform width that is sized to receive a structural beam supported on the upward facing surface of the base plate and flush between the inward-facing surfaces of the first and second upstanding plates. The bracket may further comprise a first gusset plate formed between the base plate and an outward-facing surface of the first upstanding plate, wherein the first gusset plate is perpendicular to both the base plate and the first upstanding plate. A first hole may be disposed in the base plate outside the U-channel and adjacent the first gusset plate, wherein the second end of the anchor bolt extends through the first hole in the base plate, and wherein the leveling nut is threaded onto the second end of the anchor bolt below the base plate and the top nut is threaded onto the second end of the anchor bolt above the base plate. The building may also comprise a plurality of blocks, each block being disposed between the concrete structure and the base plate of one of the brackets and in contact with the base plate directly under the U-channel.

Some embodiments provide a method of leveling a building comprising identifying a portion of a building that requires a change of elevation to achieve a level condition, identifying a bracket that is secured to a beam under the identified portion of the building, wherein a block that is disposed between a concrete structure and the identified bracket supports the beam at a first elevation. The identified bracket comprises a base plate, and first and second upstanding plates integrally formed with the base plate and extending perpendicular to the base plate, wherein the first upstanding plate is parallel to the second upstanding plate, wherein a U-channel is formed by an inward-facing surface of the first upstanding plate, an inward-facing surface of the second upstanding plate, and an upward facing surface of the base plate, wherein the U-channel has an open top opposite the upward facing surface of the base plate and first and second open ends, and wherein the U-channel has a uniform width that is sized to receive a structural beam supported on the upward facing surface of the base plate and flush between the inward-facing surfaces of the first and second upstanding plates. The bracket further comprises a first hole in the base plate outside the U-channel, wherein the second end of the anchor bolt extends through the first hole in the base plate, and wherein the leveling nut is threaded onto the second end of the anchor bolt below the base plate and the top nut is threaded onto the second end of the anchor bolt above the base plate. The method further comprises, for each anchor bolt extending through the base plate of the identified bracket, adjusting an elevation of the beam supported by the identified bracket by: loosening a top nut on the anchor bolt, turning a leveling nut on the anchor bolt to raise the identified bracket and the beam supported by the identified bracket, disposing a second block under the identified bracket to support the beam at a second elevation, turning the leveling nut to lower the identified bracket and the beam supported by the identified bracket until the weight of the beam is supported by the second block, and tightening the top nut on the anchor bolt.

DETAILED DESCRIPTION

Figure 1:
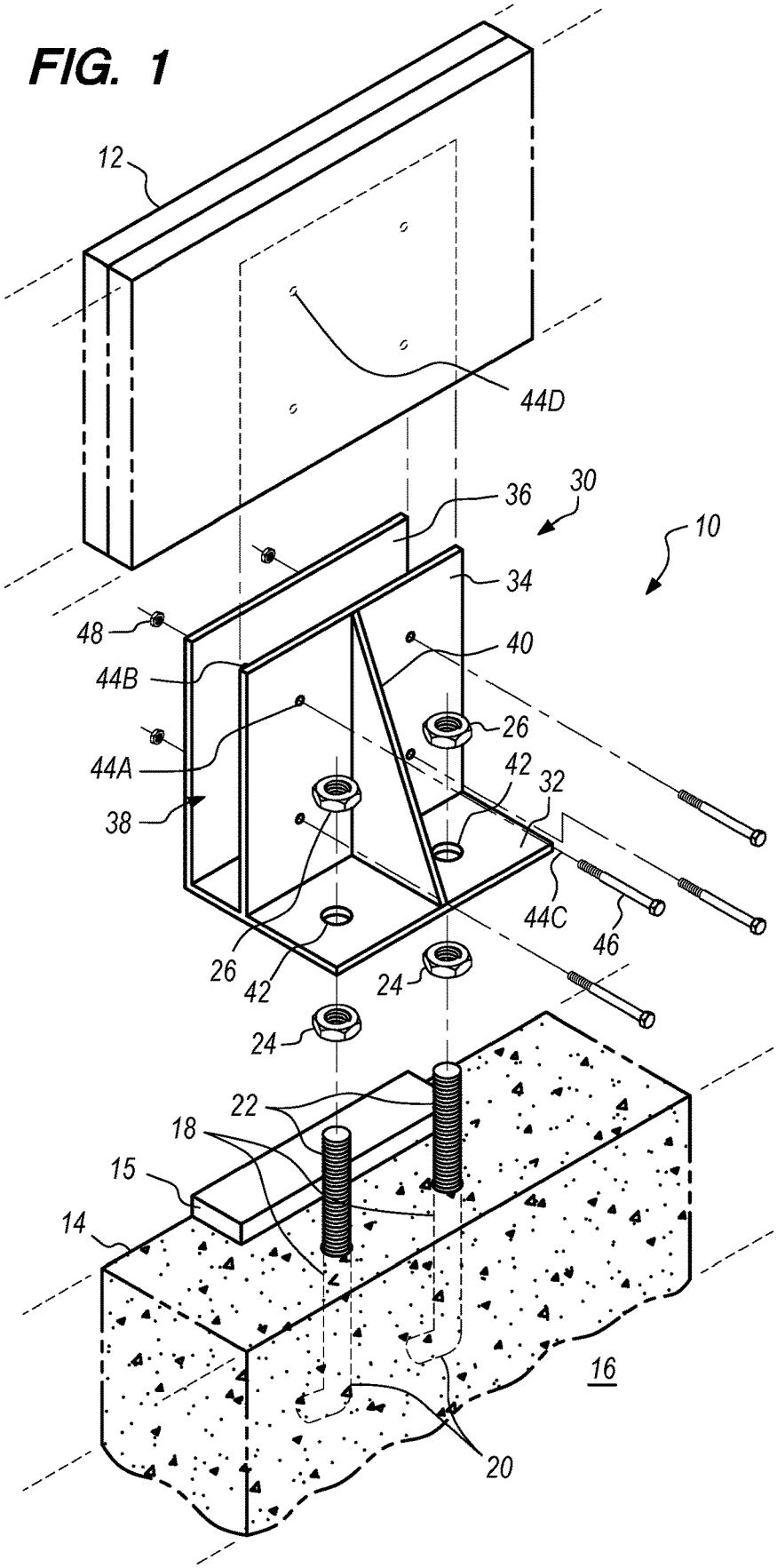
FIG. 1 is a perspective assembly view of an adjustable structure for supporting a beam above an internal pier for a building.

Some embodiments provide a bracket comprising a base plate, first and second upstanding plates integrally formed with the base plate and extending perpendicular to the base plate, a first gusset plate formed between the base plate and an outward-facing surface of the first upstanding plate, and a first hole in the base plate adjacent the first gusset plate, wherein the first gusset plate is perpendicular to both the base plate and the first upstanding plate, and wherein the first upstanding plate is parallel to the second upstanding plate. A U-channel is formed by an inward-facing surface of the first upstanding plate, an inward-facing surface of the second upstanding plate, and an upward facing surface of the base plate, wherein the U-channel has and first and second open ends and an open top opposite the upward facing surface of the base plate, and wherein the U-channel has a uniform width that is sized to receive a structural beam supported on the upward facing surface of the base plate and flush between the inward-facing surfaces of the first and second upstanding plates.

In some embodiments, the bracket may further comprise a pair of holes including a first hole through the first upstanding plate and a second hole through the second upstanding plate. The first and second holes are aligned about a centerline that is perpendicular to the first and second upstanding plates. Accordingly, with a structural beam received and supported in the U-channel, a hole may be drilled through the beam between the first and second holes. A distal end of a bolt may be inserted through the first hole, through the hole in the beam, and through the second hole, so that a nut may be threadedly connected to the distal end of the bolt. Optional embodiments may include one or more additional pair of aligned holes for further securing the bracket to the beam with a bolt and nut as described. For example, the bracket may further comprise a second pair of holes including a first hole through the first upstanding plate and a second hole through the second upstanding plate, wherein the first and second holes of the pair are aligned with a centerline that is perpendicular to the first and second upstanding plates. the second pair of holes may be vertically spaced apart from the first pair of holes, horizontally space apart from the first pair of holes, or both vertically and horizontally spaced apart from the first pair of holes. In some embodiments, the bracket will have four pairs of aligned holes, each pair having a first hole in the first upstanding plate and a second hole in the second upstanding plate.

The first hole in the base plate is sized to receive a shank of an anchor bolt therethrough. The anchor bolt has a first end securely embedded within a concrete structure and a second end extending upward from the concrete structure, wherein the second end has external threads for coupling with a leveling nut and a top nut. The shank of the anchor bolt that is received through the first hole is threaded to threadedly couple with the leveling nut below the base plate of the bracket and threadedly couple with the top nut above the base plate of the bracket. Optionally, the base plate may include additional holes sized to receive a shank from an additional anchor bolt therethrough.

In some embodiments, the bracket may comprise a second gusset plate formed between the base plate and an outward-facing surface of the second upstanding plate, wherein the second gusset plate is perpendicular to both the base plate and the second upstanding plate. A second hole may then be included in the base plate outside the U-channel and adjacent the second gusset plate. The first and second holes in the base plate are each sized to receive a shank of an anchor bolt therethrough. The first and second gusset plates add strength to the bracket and may prevent the first and second upstanding plates from bending or deflecting. Optionally, one or both of the gusset plates may extend from a lateral edge of the base plate to an upper edge of the respective upstanding plate. However, smaller gusset plates may also be used. In a further option, the base plate may include one or more additional hole adjacent the first gusset plate and one or more additional hole adjacent the second gusset plate, where each additional hole is sized to receive a shank from an additional anchor bolt therethrough. In a specific example, a base plate may include first and second holes on opposite sides of the first gusset and first and second holes on opposite sides of the second gusset.

The bracket may be made from various materials. Without limitation, the bracket may be made from a metal or a high-strength composite. The metal may be a metal alloy, such as steel (an alloy of iron and carbon) or an alloy steel (an alloy including steel in combination with another alloyant, such as manganese, nickel, chromium, molybdenum, vanadium, silicon, boron, aluminum, cobalt, copper, cerium, niobium, titanium, tungsten, tin, zinc, lead and/or zirconium). The high-strength composite may be a polymer matrix composite that includes fibers bound together by an organic polymer matrix. The polymer matrix may be either a thermoplastic polymer or a thermoset polymer, such as an epoxy, phenolic, polyurethane and/or polyimide. Optional fibers may include carbon nanotubes or graphene. The bracket is preferably a single integral piece made of the same material, such as by welding, casting or extrusion.

Some embodiments provide a bracket comprising a base plate, first and second upstanding plates integrally formed with the base plate and extending perpendicular to the base plate, as well as third and fourth upstanding plates integrally formed with the base plate and extending perpendicular to the base plate. The first upstanding plate is parallel to the second upstanding plate, wherein a first U-channel is formed by an inward-facing surface of the first upstanding plate, an inward-facing surface of the second upstanding plate, and an upward facing surface of the base plate, wherein the first U-channel has first and second open ends and an open top opposite the upward facing surface of the base plate, and wherein the first U-channel has a uniform width that is sized to receive a first structural beam supported on the upward facing surface of the base plate and flush between the inward-facing surfaces of the first and second upstanding plates. The third upstanding plate is parallel to the fourth upstanding plate, wherein a second U-channel is formed by an inward-facing surface of the third upstanding plate, an inward-facing surface of the fourth upstanding plate, and the upward facing surface of the base plate, wherein the second U-channel has an open top opposite the upward facing surface of the base plate and first and second open ends, and wherein the second U-channel has a uniform width that is sized to receive a second structural beam supported on the upward facing surface of the base plate and flush between the inward-facing surfaces of the third and fourth upstanding plates. The bracket further comprises a first hole in the base plate between the first U-channel and the second U-channel. While this bracket includes two U-channels, other features of the bracket may be constructed and/or utilized in the same or similar manner as described in reference to other bracket embodiments. For example, the first and second U-channels may each have a plurality of aligned holes therethrough, such as four pairs of aligned holes through each U-channel, each pair having a first hole in the first (third) upstanding plate and a second hole in the second (fourth) upstanding plate.

Some embodiments provide a structure for supporting a beam comprising a concrete footer or pier, and an anchor bolt having a first end securely embedded within the concrete footer or pier and a second end extending upward from the concrete footer or pier, wherein the second end has threads for coupling with a leveling nut and a top nut. The structure further comprises a bracket according to one of the disclosed embodiments of a bracket. For example, the bracket may comprise a base plate, and first and second upstanding plates integrally formed with the base plate and extending perpendicular to the base plate, wherein the first upstanding plate is parallel to the second upstanding plate, wherein a U-channel is formed by an inward-facing surface of the first upstanding plate, an inward-facing surface of the second upstanding plate, and an upward facing surface of the base plate, wherein the U-channel has an open top opposite the upward facing surface of the base plate and first and second open ends, and wherein the U-channel has a uniform width that is sized to receive a structural beam supported on the upward facing surface of the base plate and flush between the inward-facing surfaces of the first and second upstanding plates. The bracket may further comprise a first gusset plate formed between the base plate and an outward-facing surface of the first upstanding plate, wherein the first gusset plate is perpendicular to both the base plate and the first upstanding plate. A first hole may be disposed in the base plate outside the U-channel and adjacent the first gusset plate, wherein the second end of the anchor bolt extends through the first hole in the base plate, and wherein the leveling nut is threaded onto the second end of the anchor bolt below the base plate and the top nut is threaded onto the second end of the anchor bolt above the base plate. The structure may also comprise a block disposed between the concrete footer or pier and the base plate, wherein the block is positioned in contact with the base plate directly under the U-channel.

Footers (or "footings") and piers are concrete structures that may be used to establish a foundation. Footers and piers are usually embedded or formed in soil to a depth that depends upon the weight of the building or other structure being supported. For example, the footer and piers for a residential home may be formed by pouring concrete into a hole that has been dug just a few feet deep. In some embodiments, a footer extends for some distance along the soil to establish a portion of a perimeter of a foundation, whereas a pier is a column that provides a point on support within the interior of the foundation.

A beam that is received in the bracket may be made from various materials using various construction techniques. One non-limiting example of a suitable beam is a laminated veneer lumber (LVL) which resists twisting, shrinking and splitting.

An anchor bolt is a special type of bolt that is used to connect another structure to concrete. Some anchor bolts are designed to be cast-in-place with an embedded end having a hexagonal head, a bend, or a welded flange. The anchor bolt also has an exposed end that extends out of the concrete and includes threads for connection with a threaded nut.

In some embodiments, the block that is disposed between the concrete footer or pier and the base plate may support substantially all of the weight of the beam and any weight placed on the beam. Accordingly, the block is preferably positioned on the top surface of the concrete footer or pier and the bracket is lowered so that the base plate rests on top of the block. By positioning the block directly under the U-channel portion of the bracket, the block will be directly under the beam and can support the weight of the beam and any weight place on the beam. The block may extend along the entire length of the U-channel and/or base plate in order to best distribute weight of the beam to the concrete footer or pier. Furthermore, the block may have a width that is as wide as the beam U-channel and/or beam in order to best distribute weight of the beam to the concrete footer or pier, and also to prevent uneven support of the beam. In fact, the block may be wider than the U-channel and/or beam so that it may be easier for a person to position the block beneath a major portion of the U-channel and/or beam.

In some embodiments, the block has a first (initial) thickness, wherein the block is replaceable with another block or combination of blocks having a total thickness that is different than the first thickness. A thickness of a block may be described as the dimension of the block that extends is the direction from the concrete structure to the base plate of the bracket. In other words, it is the thickness of the block or combination of blocks that determines the distance of separation between the top surface of the concrete structure and the bottom surface of the base plate of the bracket. A second block, such as a shim, may be stacked with the first block to support substantially all of the weight of the beam with a total thickness that is greater than the thickness of the first block alone. Alternatively, a second block have a greater or lesser thickness than the first block may replace the first block to establish a new (greater or lesser) distance of separation between the top surface of the concrete structure and the bottom surface of the base plate of the bracket In some embodiments, structure for supporting a beam may include or utilize any of the bracket embodiments disclosed herein. For example, the structure may include a bracket having a pair of holes, including a first hole through the first upstanding plate and a second hole through the second upstanding plate, wherein the first and second holes of the pair of holes are aligned about a centerline that is perpendicular to the first and second upstanding plates. Accordingly, a bolt may extend through the first hole, through a hole in the beam and through the second hole, and the bolt may be secured with a nut. The bracket may include additional aligned pairs of holes through the first and second upstanding plates, such as four pairs of holes for receiving four bolts there through.

Some embodiments provide a building comprising a concrete structure including one or more footer and one or more pier. A plurality of anchor bolts extend from the concrete structure, where each anchor bolt has a first end securely embedded within the concrete structure and a second end extending upward from the concrete structure, wherein the second end has threads for coupling with a leveling nut and a top nut. The building further comprises a plurality of brackets, each bracket being coupled to one or more of the anchor bolts, and a plurality of beams, each beam being secured by two or more of the brackets. A floor, walls and a roof are supported by the plurality of beams. The plurality of brackets may include brackets selected from any one or more of the disclosed embodiments of a bracket. For example, the bracket may comprise a base plate, and first and second upstanding plates integrally formed with the base plate and extending perpendicular to the base plate, wherein the first upstanding plate is parallel to the second upstanding plate, wherein a U-channel is formed by an inward-facing surface of the first upstanding plate, an inward-facing surface of the second upstanding plate, and an upward facing surface of the base plate, wherein the U-channel has an open top opposite the upward facing surface of the base plate and first and second open ends, and wherein the U-channel has a uniform width that is sized to receive a structural beam supported on the upward facing surface of the base plate and flush between the inward-facing surfaces of the first and second upstanding plates. The bracket may further comprise a first gusset plate formed between the base plate and an outward-facing surface of the first upstanding plate, wherein the first gusset plate is perpendicular to both the base plate and the first upstanding plate. A first hole may be disposed in the base plate outside the U-channel and adjacent the first gusset plate, wherein the second end of the anchor bolt extends through the first hole in the base plate, and wherein the leveling nut is threaded onto the second end of the anchor bolt below the base plate and the top nut is threaded onto the second end of the anchor bolt above the base plate. The building may also comprise a plurality of blocks, each block being disposed between the concrete structure and the base plate of one of the brackets and in contact with the base plate directly under the U-channel. Embodiments of the building may include or utilize any one or more aspect of the disclosed embodiments of a structure for supporting a beam and/or any one or more aspect of the disclose embodiments of a bracket.

Some embodiments provide a method of leveling a building comprising identifying a portion of a building that requires a change of elevation to achieve a level condition, identifying a bracket that is secured to a beam under the identified portion of the building, wherein a block that is disposed between a concrete structure and the identified bracket supports the beam at a first elevation. The identified bracket comprises a base plate, and first and second upstanding plates integrally formed with the base plate and extending perpendicular to the base plate, wherein the first upstanding plate is parallel to the second upstanding plate, wherein a U-channel is formed by an inward-facing surface of the first upstanding plate, an inward-facing surface of the second upstanding plate, and an upward facing surface of the base plate, wherein the U-channel has an open top opposite the upward facing surface of the base plate and first and second open ends, and wherein the U-channel has a uniform width that is sized to receive a structural beam supported on the upward facing surface of the base plate and flush between the inward-facing surfaces of the first and second upstanding plates. The bracket further comprises a first hole in the base plate outside the U-channel, wherein the second end of the anchor bolt extends through the first hole in the base plate, and wherein the leveling nut is threaded onto the second end of the anchor bolt below the base plate and the top nut is threaded onto the second end of the anchor bolt above the base plate. The method further comprises, for each anchor bolt extending through the base plate of the identified bracket, adjusting an elevation of the beam supported by the identified bracket by: loosening a top nut on the anchor bolt, turning a leveling nut on the anchor bolt to raise the identified bracket and the beam supported by the identified bracket, disposing a second block under the identified bracket to support the beam at a second elevation, turning the leveling nut to lower the identified bracket and the beam supported by the identified bracket until the weight of the beam is supported by the second block, and tightening the top nut on the anchor bolt. The second elevation may be greater than the first elevation or less than the first elevation depending upon the thickness of the second block or blocks relative to the thickness of the first block or blocks. Embodiments of the method of leveling a building may include or utilize any one or more aspect of the disclosed embodiments of a structure for supporting a beam and/or any one or more aspect of the disclose embodiments of a bracket.

In some embodiments, the method may further comprise identifying a second bracket that supports a second beam under the identified portion of the building, wherein a second anchor bolt extends through a base plate of the identified second bracket. The method may include adjusting an elevation of the second beam supported by the identified second bracket by loosening a top nut on the second anchor bolt, turning a leveling nut on the second anchor bolt to raise the identified second bracket and the second beam supported by the identified second bracket, disposing a third block under the identified second bracket so that the identified second bracket will support the second beam at a third elevation, turning the leveling nut to lower the identified second bracket and the second beam supported by the identified second bracket, wherein the identified second bracket is lowered until the weight of the second beam is supported by the third block, and tightening the top nut on the second anchor bolt. The elevation of any of the beams in a building structure that are supported by an embodiment of the bracket may be adjusted in this manner until the building has been leveled.

FIG. 1 is a perspective assembly view of an adjustable structure 10 for supporting a beam 12 above an external footer 14 for a building. The footer 14 is embedded in the soil 16 to form a solid foundation upon which to support the building. First and second anchor bolts 18 have a first end 20 securely embedded within the concrete footer 14 and a second end 22 extending upward from the concrete footer 14, wherein the second end 22 has threads for coupling with a leveling nut 24 and a top nut 26.

A bracket 30 includes a base plate 32, a first upstanding plate 34 and a second upstanding plate 36, where both of the upstanding plates 34, 36 are integrally formed with the base plate 32 and extend perpendicular to the base plate. Furthermore, the first upstanding plate 34 is parallel to the second upstanding plate 36. A U-channel 38 is thus formed by an inward-facing surface of the first upstanding plate 34, an inward-facing surface of the second upstanding plate 36, and an upward facing surface of the base plate 32. The U-channel 38 has an open top opposite the upward facing surface of the base plate and first and second open ends. The U-channel 38 also has a uniform width (i.e., uniform distance between the plates 34, 36) that is sized to receive the beam 12 supported on the upward facing surface of the base plate 32 and flush between the inward-facing surfaces of the first and second upstanding plates 34, 36. The bracket 30 may further comprise a first gusset plate 40 formed between the base plate 32 and an outward-facing surface of the first upstanding plate assembly 34, wherein the first gusset plate 40 is perpendicular to both the base plate 32 and the first upstanding plate 34.

A first hole 42 may be disposed in the base plate 32 outside the U-channel 38 and adjacent the first gusset plate 40. The leveling nut 24 is threaded onto the second end 22 of the anchor bolt 18 below the base plate 32, the threaded second end 22 of the anchor bolt 18 extends through the first hole 42 in the base plate 32, and the top nut 26 is then threaded onto the second end 22 of the anchor bolt 18 above the base plate 32. The structure 10 may also comprise a block 15 disposed between the concrete footer 14 and the base plate 32 and positioned in contact with the base plate 32 directly under the U-channel 38. A similar second hole 42 is shown on the other side of the gusset plate 40 and is used in the same manner as the first hole 42 for receiving a second end 22 of a second anchor bolt 18.

The bracket 30 further includes a pair of holes including a first hole 44A through the first upstanding plate 34 and a second hole 44B through the second upstanding plate 36. The first and second holes 44A, 44B are aligned about a centerline 44C that is perpendicular to the first and second upstanding plates 34, 36. Accordingly, with a structural beam 12 received and supported in the U-channel 38, a hole 44D (shown in dashed lines) may be drilled through the beam 12 between the first and second holes 44A, 44B. A distal end of a bolt 46 may be inserted through the first hole 44A, through the hole in the beam 44D, and through the second hole 44B, so that a nut 48 may be threadedly connected to the distal end of the bolt 46. As shown, three additional pairs of aligned holes are spaced apart from the first pair of holes 44A, 44B for further securing the bracket 30 to the beam 12 with a three additional bolts and nuts as described.

Figure 2:
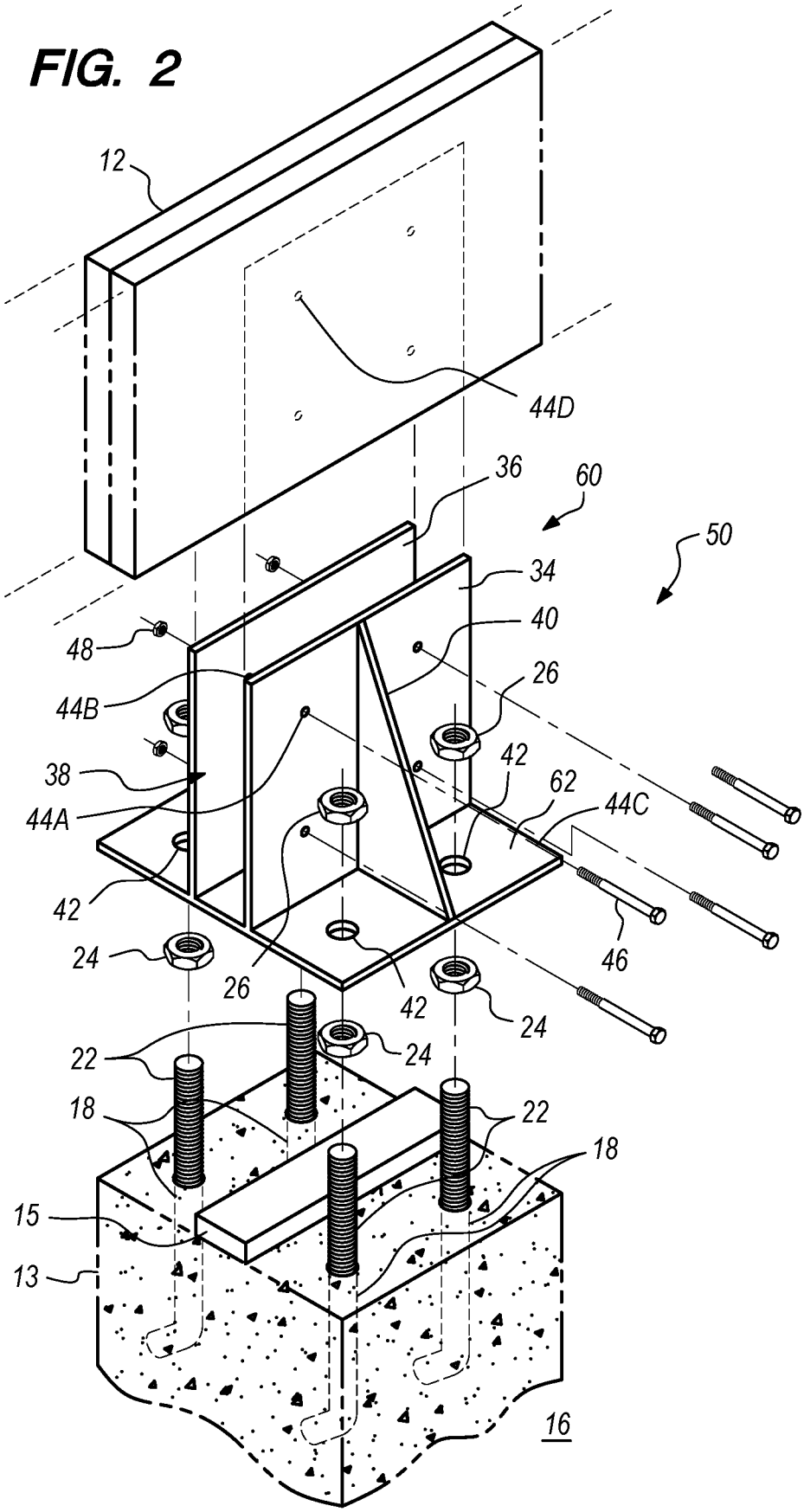
FIG. 2 is a perspective assembly view of an adjustable structure for supporting a beam above an external footer for a building.

FIG. 2 is a perspective assembly view of an adjustable structure 50 for supporting a beam 12 above an internal pier 13 for a building. In reference to FIG. 2, individual components that are similar to those of FIG. 1 may be described with the same reference numbers.

A bracket 60 includes a base plate 62 that is wider than the base plate 32 of bracket 30 in FIG. 1. However, the bracket 60 still include a first upstanding plate 34 and a second upstanding plate 36, where both of the upstanding plates 34, 36 are integrally formed with the base plate 62 and extend perpendicular to the base plate. Furthermore, the first upstanding plate 34 is parallel to the second upstanding plate 36. A U-channel 38 is thus formed by an inward-facing surface of the first upstanding plate 34, an inward-facing surface of the second upstanding plate 36, and an upward facing surface of the base plate 62. The U-channel 38 has an open top opposite the upward facing surface of the base plate and first and second open ends. The U-channel 38 also has a uniform width (i.e., uniform distance between the plates 34, 36) that is sized to receive the beam 12 supported on the upward facing surface of the base plate 62 and flush between the inward-facing surfaces of the first and second upstanding plates 34, 36.

The bracket 60 may further comprise a first gusset plate 40 formed between the base plate 62 and an outward-facing surface of the first upstanding plate assembly 34, wherein the first gusset plate 40 is perpendicular to both the base plate 32 and the first upstanding plate 34. Furthermore, the bracket 60 may further comprise a second gusset plate (not shown) that formed between the base plate 62 and an outward-facing surface of the second upstanding plate assembly 36, wherein the second gusset plate is perpendicular to both the base plate 62 and the first upstanding plate 36. The second gusset plate may be constructed the same as the first gusset plate, such as where the bracket 60 is symmetrical on either side of the U-channel 38 (see also FIGS. 7A and 7B).

Figure 7A:
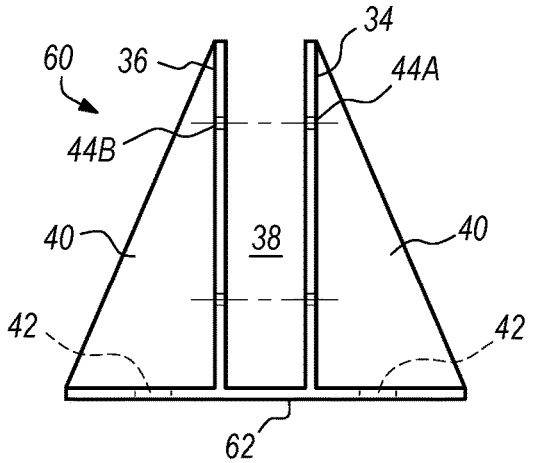
FIGS. 7A and 7B are end and top views of the bracket shown in FIG. 2
Figure 7B:
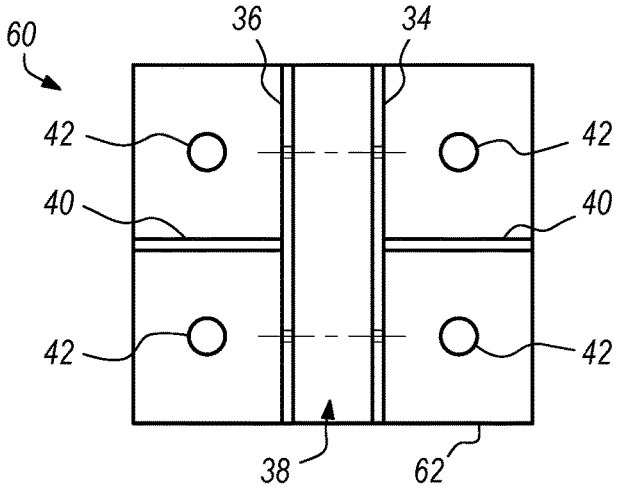

The bracket 60 has four holes 42 disposed in the base plate 62 (only three of the four holes 42 are shown) outside the U-channel 38, with two holes 42 adjacent the first gusset plate 40 and two holes 42 adjacent the second gusset plate (not shown; but see also FIGS. 7A and 7B). A leveling nut 24 is threaded onto the second end 22 of each of four anchor bolts 18 below the base plate 62 (only three leveling nuts 24 are shown), the threaded second end 22 of each anchor bolt 18 extends through a respective one of the four holes 42 in the base plate 62, and a top nut 26 is then threaded onto each of the second ends 22 of the four anchor bolts 18 above the base plate 62 (only two top nuts 26 are shown). The structure 10 may also comprise a block 15 disposed between a top surface of the concrete pier 13 and the bottom surface of the base plate 62 and positioned for contact with the base plate 62 directly under the U-channel 38. To the extent that any component of the adjustable structure 50 is not shown, the structure 50 of FIG. 2 may be considered to be symmetrical such that the front view shown in FIG. 2 is representative of a back view.

As with the bracket 30 of FIG. 1, the bracket 60 of FIG. 2 further includes a pair of holes including a first hole 44A through the first upstanding plate 34 and a second hole 44B through the second upstanding plate 36. The first and second holes 44A, 44B are aligned about a centerline 44C that is perpendicular to the first and second upstanding plates 34, 36. Accordingly, with a structural beam 12 received and supported in the U-channel 38, a hole 44D (shown in dashed lines) may be drilled through the beam 12 between the first and second holes 44A, 44B. A distal end of a bolt 46 may be inserted through the first hole 44A, through the hole in the beam 44D, and through the second hole 44B, so that a nut 48 may be threadedly connected to the distal end of the bolt 46. As shown, an additional three pairs of aligned holes are spaced apart from the first pair of holes 44A, 44B and there are three additional holes 44D in the beam for further securing the bracket 30 to the beam 12 with a three additional bolts and nuts as described.

Figure 3:
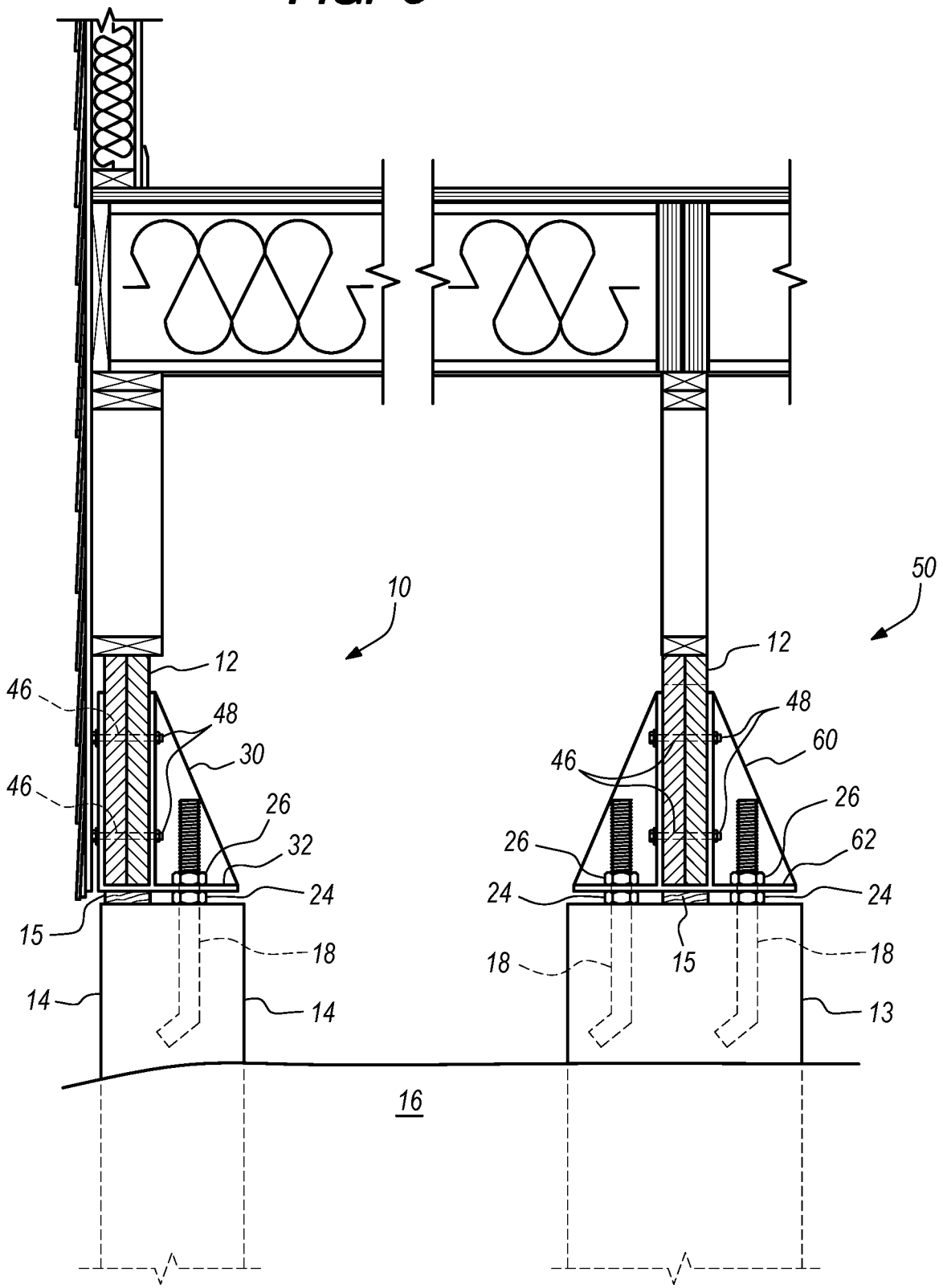
FIG. 3 is a side view of the adjustable structure for supporting a beam above an external footer for a building and the adjustable structure for supporting a beam above an internal pier for the building.

FIG. 3 is a side view of the adjustable structure 10 for supporting a beam 12 above the external footer 14 for a building in a manner consistent with FIG. 1 and the adjustable structure 50 for supporting another beam 12 above an internal pier 13 for the building (only partially shown above the beams 12) in a manner consistent with FIG. 2. However, compared with the perspective assembly views of FIGS. 1 and 2, the adjustable structures 10 and 50 have been fully assembled. Accordingly, the anchor bolts 18 have a leveling nut 24 secured under each of the base plates 32, 62 and a top nut 26 secured over each of the base plates 32, 62 with each of the base plates 32, 62 sitting on the blocks 15.

A beam 12 is received within the U-channels 38 of each bracket 30, 60 and is secured within the U-channels 38 with bolts 46 and nuts 48. The blocks 15 are disposed between the brackets 30, 60 and the footer 14 or pier 13 directly below the U-channels 38 so that the weight of the beams 12, and any weight placed on the beams by the building supported on the beams 12, is supported by the footer 14 or pier 13 through the blocks 15. Except when the building is in the process of being leveled, the weight of the beams 12 and/or the building is not supported by the anchor bolts 18.

Figure 4:
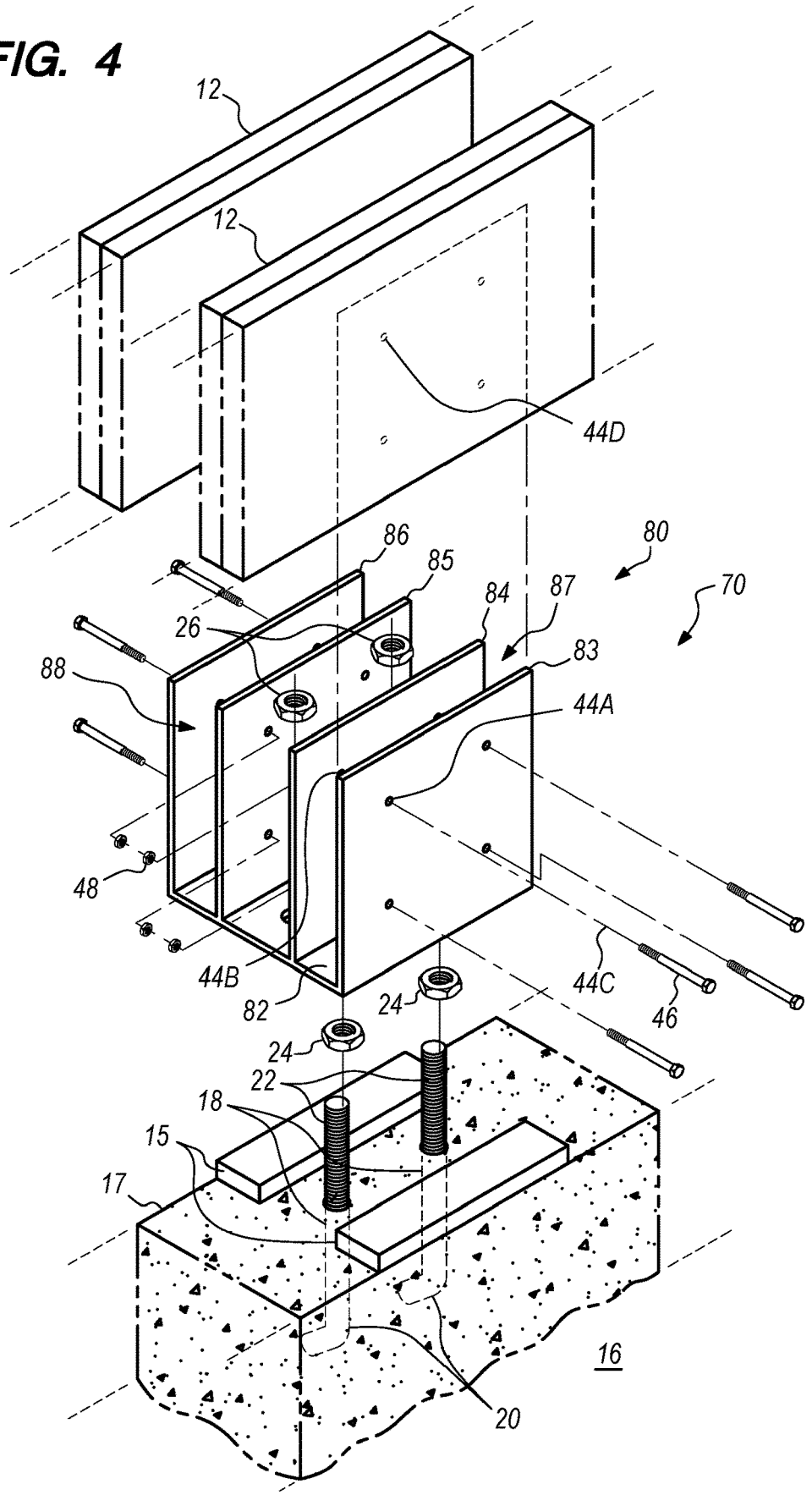
FIG. 4 is a perspective assembly view of an adjustable structure for supporting a pair of beams above an external footer for a building.

FIG. 4 is a perspective assembly view of an adjustable structure 70 for supporting a pair of beams 12 above an external footer 17 for a building. In reference to FIGS. 2 and 3, individual components that are similar to those of FIGS. 2 and 3 may be described with the same reference numbers.

A bracket 80 includes a base plate 82, first and second upstanding plates 83, 84 integrally formed with the base plate 82 and extending perpendicular to the base plate 82, as well as third and fourth upstanding plates 85, 86 integrally formed with the base plate 82 and extending perpendicular to the base plate 82. The first upstanding plate 83 is parallel to the second upstanding plate 84, wherein a first U-channel 87 is formed by an inward-facing surface of the first upstanding plate 83, an inward-facing surface of the second upstanding plate 84, and an upward facing surface of the base plate 82, wherein the first U-channel 87 has first and second open ends (to the left and right as shown in FIG. 4) and an open top opposite the upward facing surface of the base plate 82 (directed toward a beam 12), and wherein the first U-channel 87 has a uniform width that is sized to receive a first structural beam 12 supported on the upward facing surface of the base plate 82 and flush between the inward-facing surfaces of the first and second upstanding plates 83, 84. The third upstanding plate 85 is parallel to the fourth upstanding plate 86, wherein a second U-channel 88 is formed by an inward-facing surface of the third upstanding plate 85, an inward-facing surface of the fourth upstanding plate 86, and the upward facing surface of the base plate 82, wherein the second U-channel 88 has an open top opposite the upward facing surface of the base plate 82 (directed toward a beam 12) and first and second open ends (to the left and right as shown in FIG. 4), and wherein the second U-channel 88 has a uniform width that is sized to receive a second structural beam 12 supported on the upward facing surface of the base plate 82 and flush between the inward-facing surfaces of the third and fourth upstanding plates 85, 86. The bracket 80 further comprises a first hole 42 (not shown; but see FIGS. 8A and 8B) in the base plate 82 outside between first U-channel 87 and the second U-channel 88 (i.e., between the second and third upstanding plates 84, 85). While this bracket 80 includes two U-channels 87, 88, other features of the bracket 80 may be constructed and/or utilized in the same or similar manner as described in reference to other bracket embodiments.

A leveling nut 24 is threaded onto the second end 22 of each of two anchor bolts 18 below the base plate 82, the threaded second end 22 of each anchor bolt 18 extends through a respective one of the two holes 42 (not shown; but see FIGS. 8A and 8B) in the base plate 82, and a top nut 26 is then threaded onto each of the second ends 22 of the two anchor bolts 18 above the base plate 82. The structure 70 may also comprise two blocks 15 disposed between a top surface of the concrete footer 17 and the bottom surface of the base plate 82 and positioned for contact with the base plate 82. One of the blocks 15 is positioned directly under each of the two U-channels 87, 88 so that the weight of each beam 12, and any weight supported on each beam 12, is supported by the block 15 directly below the respective beam 12.

The bracket 80 further includes a pair of holes including a first hole 44A through the first upstanding plate 83 and a second hole 44B through the second upstanding plate 84. The first and second holes 44A, 44B are aligned about a centerline 44C that is perpendicular to the first and second upstanding plates 83, 84. Accordingly, with a structural beam 12 received and supported in the first U-channel 87, a hole 44D (shown in dashed lines) may be drilled through the beam 12 between the first and second holes 44A, 44B. A distal end of a bolt 46 may be inserted through the first hole 44A, through the hole in the beam 44D, and through the second hole 44B, so that a nut 48 may be threadedly connected to the distal end of the bolt 46. As shown, an additional three pairs of aligned holes are spaced apart from below the first pair of holes 44A, 44B and an additional three holes in the beam are provided for further securing the bracket 30 to the beam 12 with an additional three bolts and nuts as described. Furthermore, a second set of bolts and nuts, such as an additional four bolts and nuts, may be used as shown to secure a second beam 12 in the second U-channel 88 in the same manner. Only the four nuts 48 for the four bolts/holes in the left side of the upstanding plates are shown, but there would be an additional four nuts for the four bolts/holes in the right side of the upstanding plates.

Figure 5:
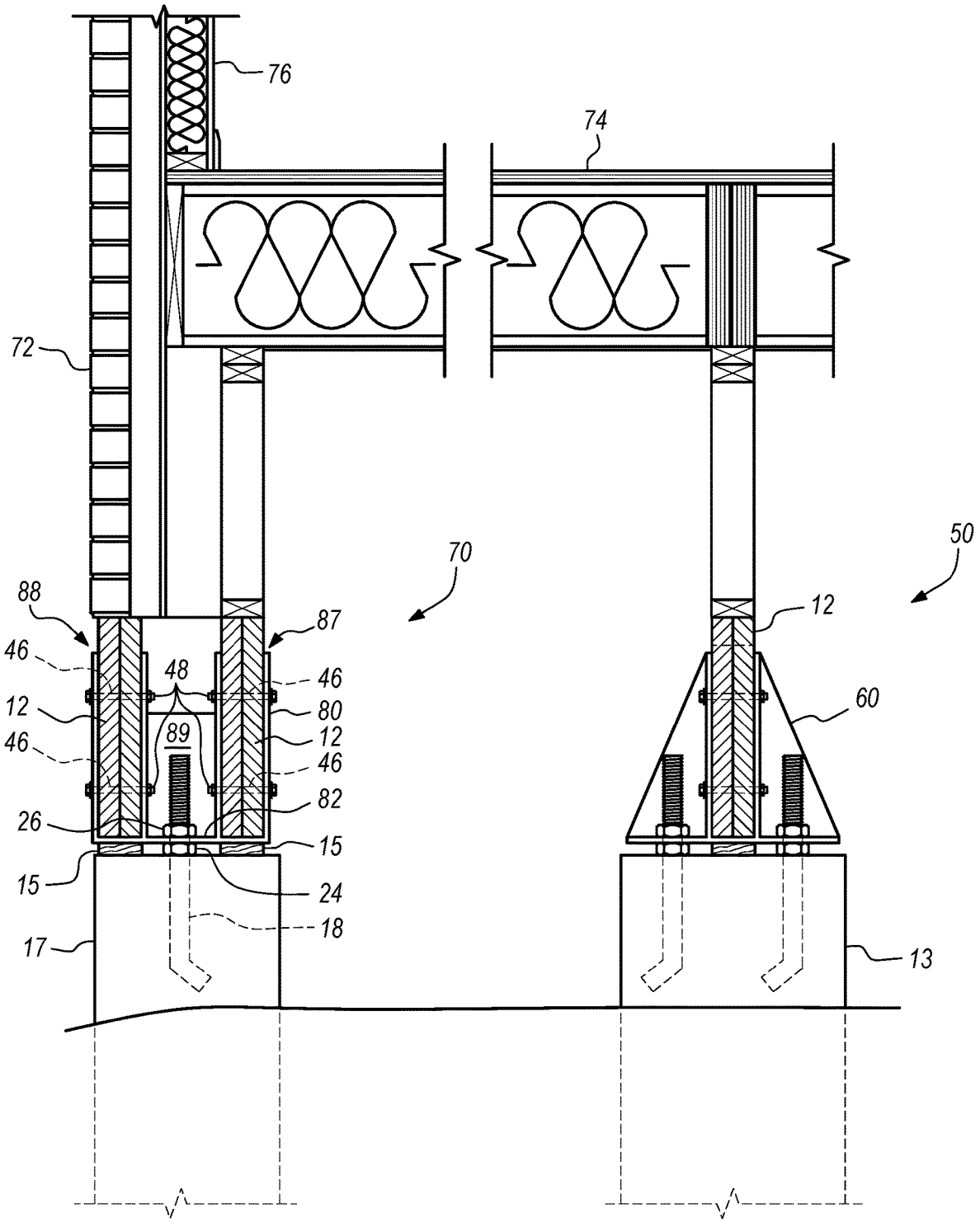
FIG. 5 is a side view of the adjustable structure for supporting a pair of beams above an external footer for a building and the adjustable structure for supporting a beam above an internal pier for the building.

FIG. 5 is a side view of the adjustable structure 70 for supporting a pair of beams 12 above an external footer 17 for a building in a manner consistent with FIG. 4 and the adjustable structure 50 for supporting a beam 12 above an internal pier 13 for the building in a manner consistent with FIG. 2. The adjustable structure 50 is the same as described in reference to FIGS. 2 and 3, so a description of the adjustable structure 50 is not repeated here. However, compared with the perspective assembly view of FIG. 4, the adjustable structure 70 has been fully assembled. Accordingly, the anchor bolts 18 have a leveling nut 24 secured under the base plate 82 and a top nut 26 secured over the base plate 82 with the base plate sitting on the blocks 15.

A beam 12 is received within the first U-channel 87 of the bracket 80 and is secured within the U-channel 87 with bolts 46 and nuts 48. The blocks 15 are disposed between the base plate 82 of the bracket 80 and the footer 17 directly below each of the U-channels 87, 88 so that the weight of each beam 12, and any weight placed on the beam by the building supported on the beam 12, is supported by the footer 17 through the respective blocks 15. Except when the building is in the process of being leveled, the weight of the beams 12 and/or the building is not supported by the anchor bolts 18.

The bracket 80 may further include a gusset plate 89 that extends laterally between the second upstanding plate 84 and the third upstanding plate 85 to provide additional stability and/or rigidity to the bracket 80.

The bracket 80 may be a preferably embodiment for supported a building with a brick facade 72. Accordingly, the weight of the brick façade 72 is supported by one (outer) beam 12 and the weight of the floor 74, interior walls 76 and roof (not shown, but see FIG. 11B) is supported by another (inner) beam 12.

Because the blocks 15 are disposed between the bracket 80 and the footer 17 directly below the U-channels 87, 88 so that the weight of the beams 12, and any weight placed on the beams by the bricks and building supported on the beams 12, is supported by the footer 17 through the blocks 15. Except when the building is in the process of being leveled, the weight of the beams 12 and/or the bricks and building is not supported by the anchor bolts 18.

Figure 6A:
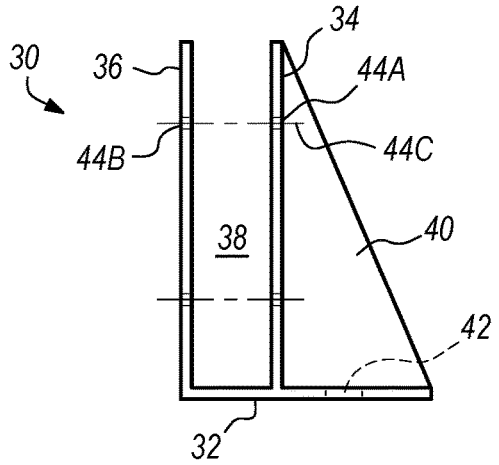
FIGS. 6A and 6B are end and top views of the bracket shown in FIG. 1
Figure 6B:
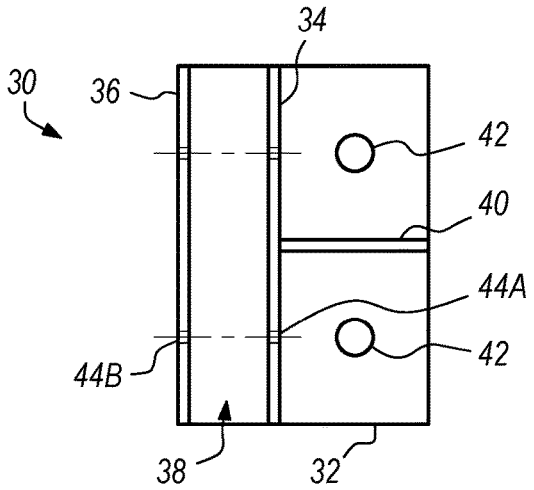

FIGS. 6A and 6B are end and top views of the bracket 30 shown in FIG. 1. The bracket 30 includes a base plate 32, first and second upstanding plates 34, 36 integrally formed with the base plate 32 and extending perpendicular to the base plate 32, a first gusset plate 40 formed between the base plate 32 and an outward-facing surface of the first upstanding plate 34, and a pair of holes 42 in the base plate 32 adjacent the first gusset plate 40, wherein the first gusset plate 40 is perpendicular to both the base plate 32 and the first upstanding plate 34, and wherein the first upstanding plate 34 is parallel to the second upstanding plate 36. The holes 42 in the base plate 32 are sized to receive a shank of an anchor bolt therethrough. A U-channel 38 is formed by an inward-facing surface of the first upstanding plate 34, an inward-facing surface of the second upstanding plate 36, and an upward facing surface of the base plate 32, wherein the U-channel 38 has and first and second open ends (see the end view in FIG. 6A) and an open top (see top view in FIG. 6B) opposite the upward facing surface of the base plate 32, and wherein the U-channel has a uniform width that is sized to receive a structural beam supported on the upward facing surface of the base plate 32 and flush between the inward-facing surfaces of the first and second upstanding plates 34, 36. Each of the first upstanding plates 34 has four holes 44A that are aligned with four holes 44B in the second upstanding plates 36.

FIGS. 7A and 7B are end and top views of the bracket 60 shown in FIG. 2. The bracket 60 includes all of the elements of bracket 30 (see FIGS. 6A and 6B), but has a base plate 62 with that extends further laterally (left as shown in FIG. 7A) and further includes a second gusset plate 40 formed between the base plate 62 and an outward-facing surface of the second upstanding plate 36, wherein the second gusset plate 40 is perpendicular to both the base plate 62 and the second upstanding plate 36. A second hole 42 may then be included in the base plate 62 outside the U-channel 38 and adjacent the second gusset plate 40. The first and second holes 42 in the base plate 62 are each sized to receive a shank of an anchor bolt therethrough. The first and second gusset plates 40 add strength to the bracket 60 and may prevent the first and second upstanding plates 34, 36 from bending or deflecting. As shown in FIG. 7B, the base plate 62 may include a total of four holes 42, where each additional hole is sized to receive a shank from an anchor bolt therethrough. Each of the first upstanding plates 34 has four holes 44A that are aligned with four holes 44B in the second upstanding plates 36.

Figure 8A:
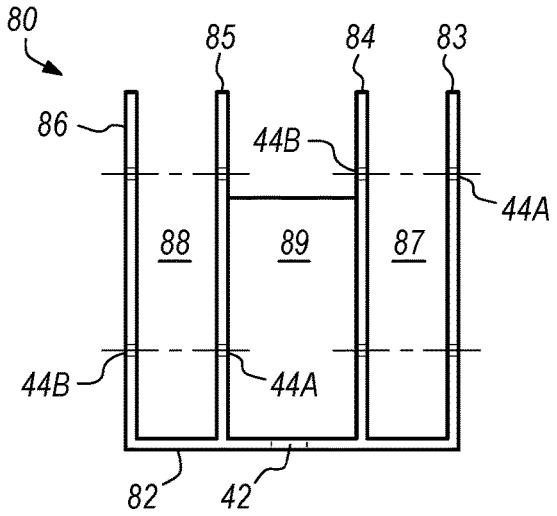
FIGS. 8A and 8B are end and top views of the bracket shown in FIG. 4
Figure 8B:
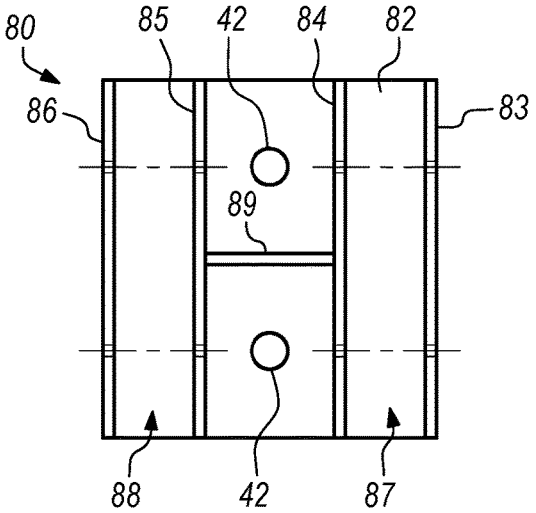

FIGS. 8A and 8B are end and top views of the bracket 80 shown in FIG. 4. The bracket 80 include a base plate 82, first and second upstanding plates 83, 84 integrally formed with the base plate 82 and extending perpendicular to the base plate 82, as well as third and fourth upstanding plates 85, 86 integrally formed with the base plate 82 and extending perpendicular to the base plate 82. The first upstanding plate 83 is parallel to the second upstanding plate 84, wherein a first U-channel 87 is formed by an inward-facing surface of the first upstanding plate 83, an inward-facing surface of the second upstanding plate 84, and an upward facing surface of the base plate 82, wherein the first U-channel 87 has first and second open ends and an open top opposite the upward facing surface of the base plate 82, and wherein the first U-channel 87 has a uniform width that is sized to receive a first structural beam supported on the upward facing surface of the base plate 82 and flush between the inward-facing surfaces of the first and second upstanding plates 83, 84. The third upstanding plate 85 is parallel to the fourth upstanding plate 86, wherein a second U-channel 88 is formed by an inward-facing surface of the third upstanding plate 85, an inward-facing surface of the fourth upstanding plate 86, and the upward facing surface of the base plate 82, wherein the second U-channel 88 has an open top opposite the upward facing surface of the base plate 82 and first and second open ends, and wherein the second U-channel 88 has a uniform width that is sized to receive a second structural beam supported on the upward facing surface of the base plate 82 and flush between the inward-facing surfaces of the third and fourth upstanding plates 85, 86. The bracket 80 further comprises a pair of holes 42 in the base plate 82 outside between first U-channel 87 and the second U-channel 88 for receiving anchor bolts. The gusset plate 89 is shown extending between the second and third upstanding plates 84, 85. While this bracket 80 includes two U-channels 87, 88, other features of the bracket 80 may be constructed and/or utilized in the same or similar manner as described in reference to other bracket embodiments.

FIGS. 9A to 9F provide a sequence of diagrams illustrating steps of installing a bracket 60 of an adjustable structure 50 for supporting a beam (not shown). It should be recognized that although the number of anchor bolts 18 and the number of holes 42 vary from one bracket embodiment to another, and hence also the number of leveling nuts 24 and top nuts 26 also varies from one bracket embodiment to another, the basic steps of installing a bracket are essentially the same regardless of which bracket embodiment is being used.

Figure 9A:
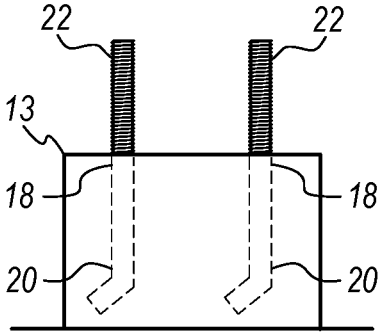
FIGS. 9A to 9F provide a sequence of diagrams illustrating steps of installing a bracket of an adjustable structure for supporting a beam.

In FIG. 9A, the concrete pier 13 has been formed with the anchor bolts 18 having a first end 20 embedded in the concrete and a threaded second end 22 extending upward from the top surface of the pier 13. Note the curved tip on the embedded first end 20 that may help support the anchor bolt and/or to prevent turning of the anchor bolt 18 when a nut is threaded onto or along the anchor bolt.

Figure 9B:
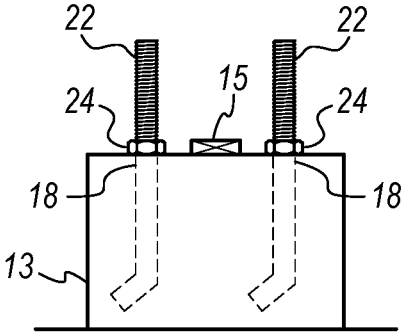

In FIG. 9B, a leveling nut 24 is threaded onto the threaded second end 22 of each anchor bolt 18. In addition, a block 15 has been placed on the top surface of the pier 13 between the two anchor bolts 18.

Figure 9C:
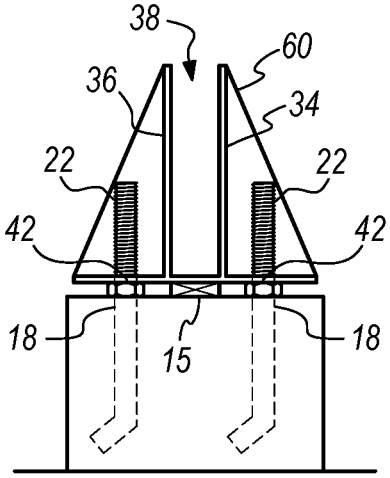

In FIG. 9C, the bracket 60 has been positioned to rest on the block 15 with the threaded second end 22 of the anchor bolt 18 received through holes 42 in the base plate 62 of the bracket 60. The first and second upstanding plates 34, 36, along with the upward facing surface of the base plate 62 for a U-channel 38.

Figure 9D:
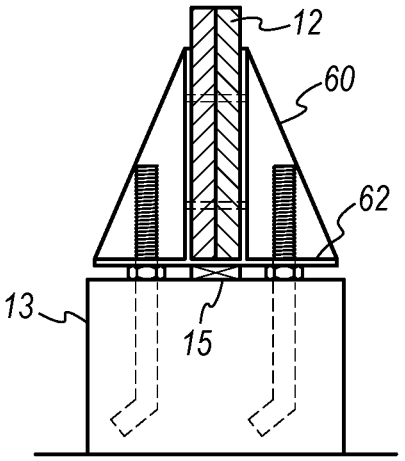

In FIG. 9D, the beam 12 has been received through the open top of the U-channel 38, such that the beam 12 rests against the base plate 62 which rests on the block 15. As a result, the weight of the beam 12 is supported by the pier 13 through the block 15. Each beam 12 in a building structure may be supported by one or more brackets 60 along the length of the beam. So, if the beam 12 is not level prior to constructing the building on the beam, the beam 12 may be leveled by lifting the beam and replacing the block 15 with another block having a different thickness. If the beam is not easily lifted by hand, then the leveling nuts may be used to raise the beam to facilitate replacement of the block 15. This can be repeated any number of times, until the beam is level. In fact, a block associated with any of the brackets supporting any of the beams in a building structure may be replaced or supplemented with shims or other materials until the entire beam structure for supporting a building is level.

Figure 9E:
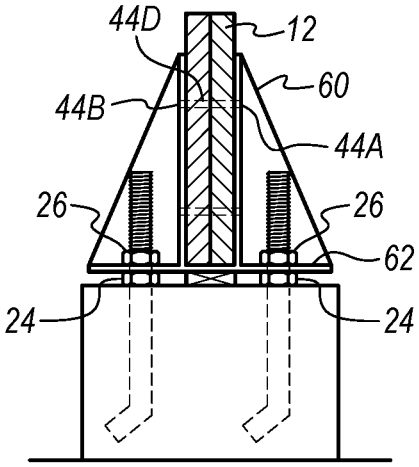

In FIG. 9E, the leveling nuts 24 may be raised, if desired, to simply prevent the bracket from rocking from side to side without actually supporting any weight of the beam. Then, the top nuts 26 are tightened down onto the base plate 62 to hold the bracket 60 down against the block 15. At this point, holes 44D may be drilled through the beam 12 by running a drill bit between the aligned holes 44A, 44B. In the embodiments shown, each U-channel has four pair of aligned holes such that the beam may be drilled to form four holes in the beam. Accordingly, four bolts may be extended there through and secured with a nut.

Figure 9F:
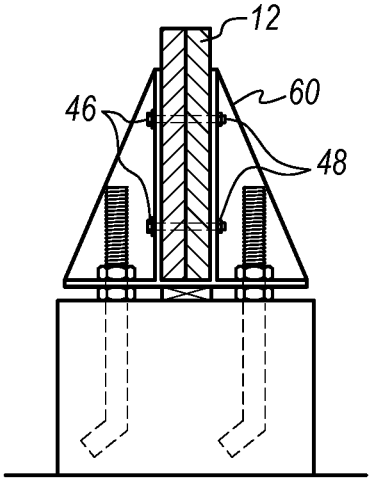

In FIG. 9F, the bolts 46 are run through the aligned holes 44A, 44B and the hole 44D through the beam 12. The nut 48 is then tightened down to secure the beam 12 to the bracket 60. When each beam of the building structure has been leveled and secured in this manner, the remainder of the building structure may be constructed on the beams.

FIGS. 10A to 10F provide a sequence of diagrams illustrating steps of adjusting the elevation of a beam, which may be included in a method of leveling a building. It should be understood that the beams 12 shown in FIGS. 10A to 10F may already support a finished building with additional contents within the building. Accordingly, the weight of the beams 12 may be relatively minor in relation to the weight of the building and building contents that is being supported by the beams 12. Therefore, adjusting the elevation of a beam 12 using one of the adjustable structures 10, 50, 70 of FIGS. 1, 2, 4 requires raising or lifting the weight of the beam 12 and all of the weight being supported by the beam 12. Furthermore, it should be understood that the crawlspace under a building of this type enables a person to gain access to the adjustable structures, but would prevent access by forklifts, backhoes and other heavy equipment.

Figure 10A:
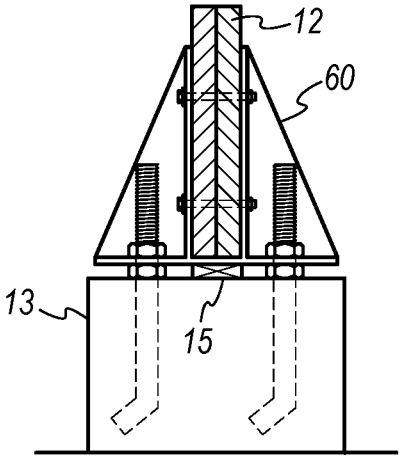
FIGS. 10A to 10F provide a sequence of diagrams illustrating steps of adjusting the elevation of a beam.

In FIG. 10A, the beam 12 is supported as described in reference to FIG. 9F. However, as part of a method for leveling a building, assume that the beam 12 has been identified as being located in a portion of a building that requires a change of elevation to achieve a level condition, and that bracket 60 is secured to the identified beam 12 or portion of the beam under the identified portion of the building.

Figure 10B:
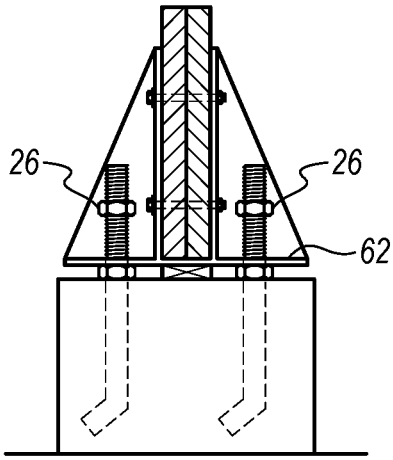
Figure 10C:
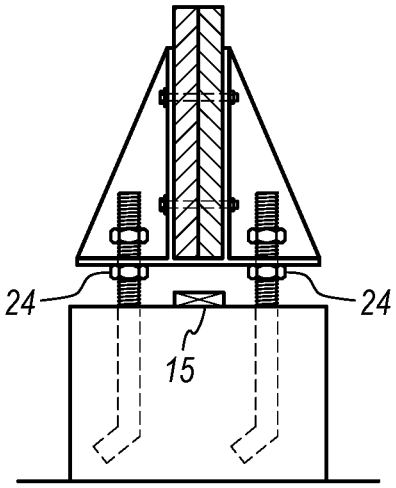

In FIG. 10B, the top nuts 26 are raised (by turning) to disengage the base plate 62. In FIG. 10C, the leveling nuts 24 having been raised (by turning) to lift the beam 12 off the block 15. Note that the leveling nuts 24 may be accessed from the side with an open end wrench (not shown).

Figure 10D:
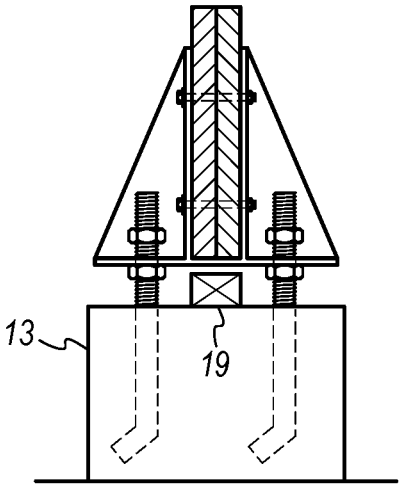

In FIG. 10D, the block 15 (from FIG. 10C) has been replaced with a second new/different block 19 having different thickness than the first block 15. Note that the beam 12 and bracket 60 must be raised to take pressure off the block 15 for removal even if the new/different block 19 has a thickness that is less than the thickness of block 15. So, the thickness of the new/different block 19 is selected in order provide a desired amount of increase or decrease in elevation of the beam 12 at the location of the pier 13. It should be understood that the change in elevation of the beam is the direct result of the change in thickness between the previous block 15 and the new/different block 19. Furthermore, the change in elevation and/or the change in thickness may be accomplished either by replacing the block 15 or by adding or removing shims in a stack with block 15. Therefore, while the blocks 15, 19 are shown as single blocks, they may be considered to represent any one or more combination of blocks. Each block may be made with wood, metal or a composite material.

Figure 10E:
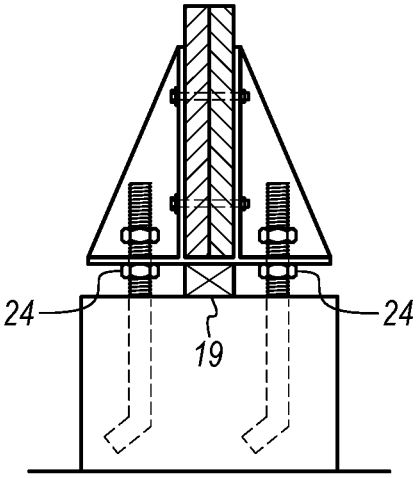
Figure 10F:
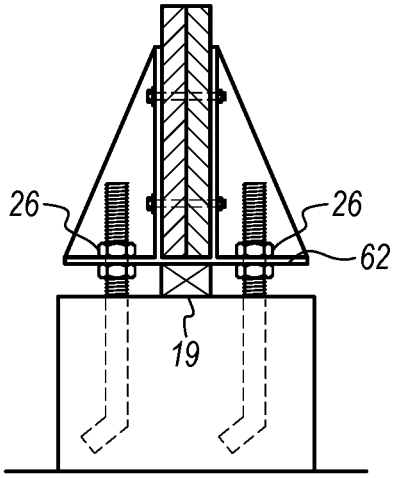

In FIG. 10E, the leveling nuts 24 are lowered (by turning) so that the weight of the beam 12 and any weight supported by the beam 12 rests against the new/different block 19. In FIG. 10F, the top nuts 26 are lowered (by turning) until the top nuts 26 are tightened down against the base plate 62. The beam is now supported at a second elevation that may be greater than the first elevation or less than the first elevation depending upon the thickness of the second block or blocks relative to the thickness of the first block or blocks. Embodiments of the method of leveling a building may include or utilize any one or more aspect of the disclosed embodiments of a structure for supporting a beam and/or any one or more aspect of the disclose embodiments of a bracket.

Furthermore, the method may include identifying a second bracket that supports a second beam under the identified portion of the building, wherein a second anchor bolt extends through a base plate of the identified second bracket. The method may include adjusting an elevation of the second beam supported by the identified second bracket by loosening a top nut on the second anchor bolt, turning a leveling nut on the second anchor bolt to raise the identified second bracket and the second beam supported by the identified second bracket, disposing a third block under the identified second bracket so that the identified second bracket will support the second beam at a third elevation, turning the leveling nut to lower the identified second bracket and the second beam supported by the identified second bracket, wherein the identified second bracket is lowered until the weight of the second beam is supported by the third block, and tightening the top nut on the second anchor bolt. The elevation of any of the beams in a building structure that are supported by an embodiment of the bracket may be adjusted in this manner until the building has been leveled.

Figure 11A:
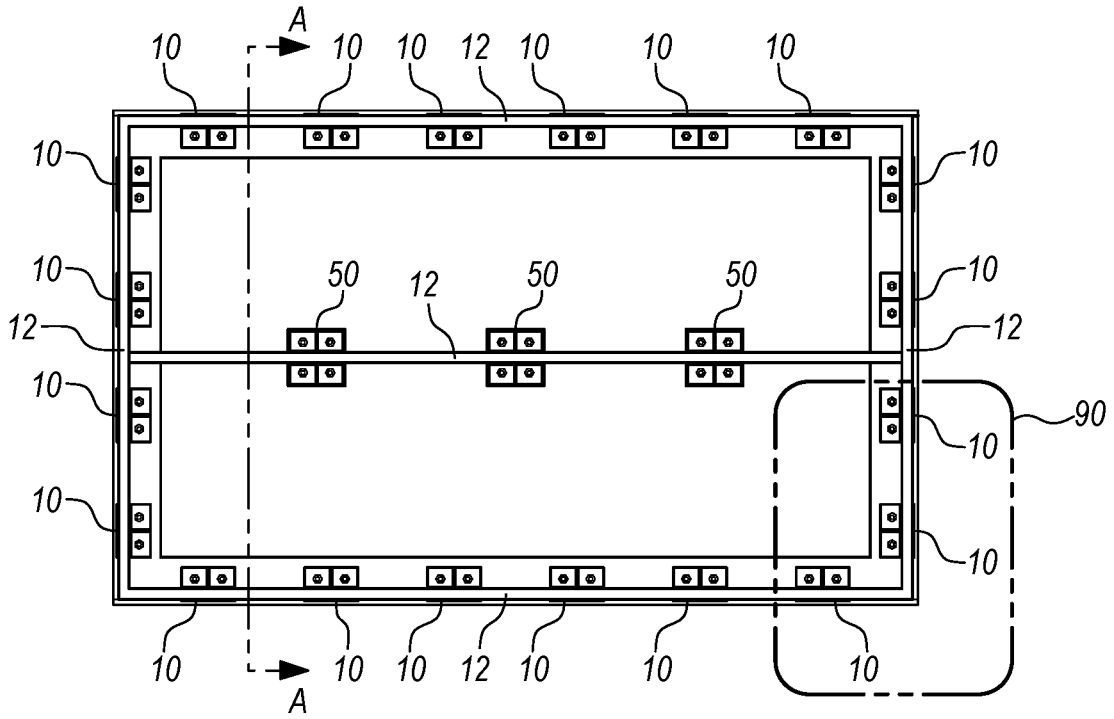
FIG. 11A is a plan view of a plurality of adjustable structures supporting beams for a building.

FIG. 11A is a plan view of a plurality of adjustable structures 10, 50 supporting beams 12 for a building. A greater or lesser number of beams 12 may be used in this or any other configuration to support a desired building. Furthermore, if a method of leveling a building identified that the portion 90 of the building has sagged and was no longer level, the three adjustable structures 10 in the identified portion 90 could be adjusted as described in reference to FIGS. 10A to 10F until that portion of the building was level with the rest of the building. Any one or more of the adjustable structures 10, 50 may be adjusted upward and/or downward in elevation by any variable amount as necessary to level the building.

Figure 11B:
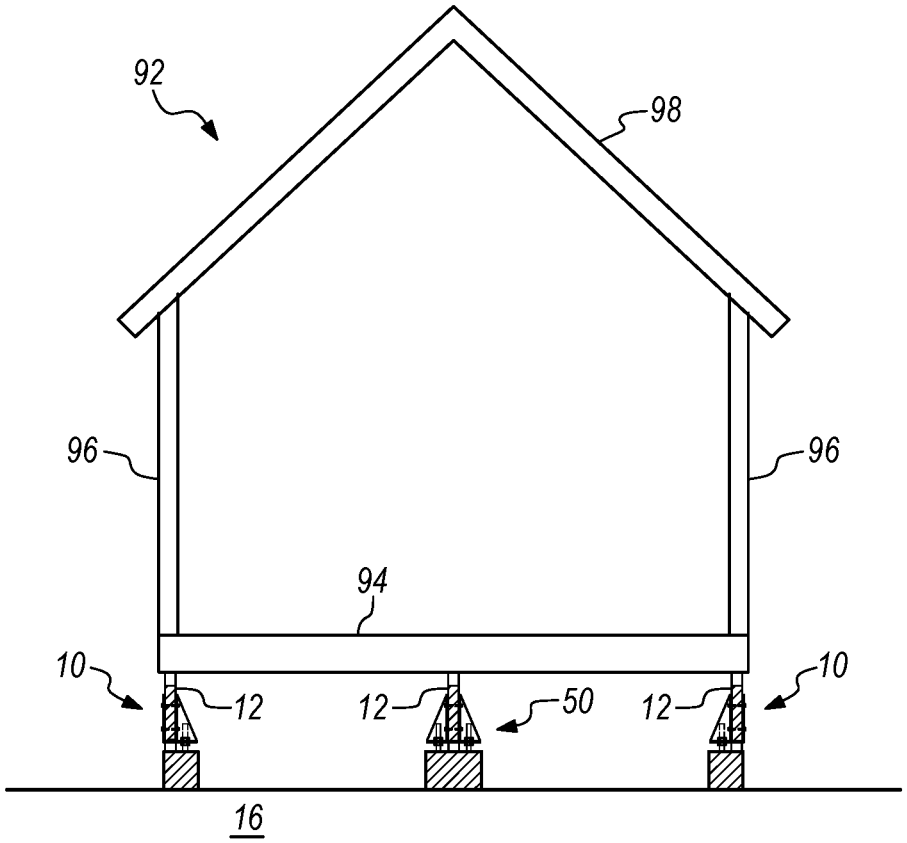
FIG. 11B is a cross-sectional side view of a building supported on the beams of FIG. 11A as viewed along line A-A.

FIG. 11B is a cross-sectional side view of a building 92 supported on the beams 12 of FIG. 11A as viewed along line A-A. Collectively, the beams 12 may support a floor 94, walls 96 and a roof 98, as well as any contents of the building 92.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. A structure for supporting a structural beam, comprising;

a concrete footer or pier;

an anchor bolt having a first end securely embedded within the concrete footer or pier and a second end extending upward from the concrete footer or pier, wherein the second end has threads for coupling with a leveling nut and a top nut;

a bracket comprising:

a base plate;

first and second upstanding plates integrally formed with the base plate and extending perpendicular to the base plate, wherein the first upstanding plate is parallel to the second upstanding plate, wherein a U-channel is formed by an inward-facing surface of the first upstanding plate, an inward-facing surface of the second upstanding plate, and an upward facing surface of the base plate, wherein the U-channel has an open top opposite the upward facing surface of the base plate and first and second open ends, and wherein the U-channel has a uniform width that is sized to receive the structural beam supported on the upward facing surface of the base plate and flush between the inward-facing surfaces of the first and second upstanding plates;

a first gusset plate formed between the base plate and an outward-facing surface of the first upstanding plate, wherein the first gusset plate is perpendicular to both the base plate and the first upstanding plate; and a first hole in the base plate outside the U-channel and adjacent the first gusset plate, wherein the second end of the anchor bolt extends through the first hole in the base plate, and wherein the leveling nut is threaded onto the second end of the anchor bolt below the base plate and the top nut is threaded onto the second end of the anchor bolt above the base plate; and a block disposed between the concrete footer or pier and the base plate, wherein the block is positioned in contact with the base plate directly under the U-channel.

2. The structure of claim 1, further comprising:

a second anchor bolt having a first end securely embedded within the concrete footer or pier and a second end extending upward from the concrete footer or pier, wherein the second end of the second anchor bolt has threads for coupling with a second leveling nut and a second top nut; and wherein the bracket further comprises a second hole in the base plate outside the U-channel and adjacent the first gusset plate, wherein the second end of the second anchor bolt extends through the second hole in the base plate, and wherein the second leveling nut is threaded onto the second end of the second anchor bolt below the base plate and the second top nut is threaded onto the second end of the second anchor bolt above the base plate, and wherein the first and second holes in the base plate are on opposite sides of the first gusset plate.

3. The structure of claim 1, further comprising:

a second anchor bolt having a first end securely embedded within the concrete footer or pier and a second end extending upward from the concrete footer or pier, wherein the second end of the second anchor bolt has threads for coupling with a second leveling nut and a second top nut; and wherein the bracket further comprises a second hole in the base plate outside the U-channel and adjacent the second gusset plate, wherein the second end of the second anchor bolt extends through the second hole in the base plate, and wherein the second leveling nut is threaded onto the second end of the second anchor bolt below the base plate and the second top nut is threaded onto the second end of the second anchor bolt above the base plate.

4. The structure of claim 1, further comprising:

a first pair of holes including a first hole through the first upstanding plate and a second hole through the second upstanding plate, wherein the first and second holes of the first pair of holes are aligned about a centerline that is perpendicular to the first and second upstanding plates, and wherein the first and second holes are positioned to receive first and second ends of a bolt that extends through a first hole in the beam.

5. The structure of claim 4, wherein the bracket further comprises:

a second pair of holes including a third hole through the first upstanding plate and a fourth hole through the second upstanding plate, wherein the third and fourth holes of the second pair of holes are aligned about a centerline that is perpendicular to the first and second upstanding plates, and wherein the third and fourth holes are positioned to receive first and second ends of a second bolt that extends through a second hole in the beam.

6. The structure of claim 5, wherein the second pair of holes are horizontally spaced apart from the first pair of holes with the gusset plate positioned between the first and second pairs of holes.

7. The structure of claim 1, wherein the block supports substantially all weight of the beam.

8. The structure of claim 7, wherein the block has a first thickness, and wherein the block is replaceable with another block or combination of blocks having a total thickness that is different than the first thickness.

9. The structure of claim 7, wherein the block has a first thickness, and wherein a second block is stackable with the first block to support substantially all of the weight of the beam with a total thickness that is greater than the first thickness.

10. A building, comprising:

a concrete structure comprising one or more footer and one or more pier;

a plurality of anchor bolts extending from the concrete structure, each anchor bolt having a first end securely embedded within the concrete structure and a second end extending upward from the concrete structure, wherein the second end has threads for coupling with a leveling nut and a top nut;

a plurality of brackets, each bracket coupled to one or more of the anchor bolts;

a plurality of structural beams, each beam secured by two or more of the brackets; and a floor, walls and a roof supported by the plurality of beams;

wherein each bracket comprises:

a base plate;

first and second upstanding plates integrally formed with the base plate and extending perpendicular to the base plate, wherein the first upstanding plate is parallel to the second upstanding plate, wherein a U-channel is formed by an inward-facing surface of the first upstanding plate, an inward-facing surface of the second upstanding plate, and an upward facing surface of the base plate, wherein the U-channel has an open top opposite the upward facing surface of the base plate and first and second open ends, and wherein the U-channel has a uniform width that is sized to receive one of the structural beams supported on the upward facing surface of the base plate and flush between the inward-facing surfaces of the first and second upstanding plates;

a first gusset plate formed between the base plate and an outward-facing surface of the first upstanding plate, wherein the first gusset plate is perpendicular to both the base plate and the first upstanding plate; and a first hole in the base plate outside the U-channel and adjacent the first gusset plate, wherein the second end of the anchor bolt extends through the first hole in the base plate, and wherein the leveling nut is threaded onto the second end of the anchor bolt below the base plate and the top nut is threaded onto the second end of the anchor bolt above the base plate; and a plurality of blocks, each block disposed between one of the concrete footers or piers and one of the base plates so that the block is positioned in contact with the base plate directly under the U-channel of the base plate.

11. The building of claim 10, wherein each block supports substantially all weight placed on the bracket that contacts the block.

12. The building of claim 10, wherein each block is replaceable with another block or combination of blocks having a total thickness that is different than a thickness of the block.

13. The building of claim 10, wherein each block is stackable with an additional block to increase a distance between the bracket and the concrete structure.

14. The building of claim 10, wherein each bracket further comprises a second hole in the base plate outside the U-channel and adjacent the first gusset plate, wherein the second end of a further one of the anchor bolts extends through the second hole in the base plate, and wherein a further leveling nut is threaded onto the second end of the further anchor bolt below the base plate and a further top nut is threaded onto the second end of the further anchor bolt above the base plate, and wherein the first and second holes in the base plate are on opposite sides of the first gusset plate.

15. The building of claim 10, wherein each bracket further comprises:

a second gusset plate formed between the base plate and an outward-facing surface of the second upstanding plate, wherein the second gusset plate is perpendicular to both the base plate and the second upstanding plate; and a second hole in the base plate outside the U-channel and adjacent the second gusset plate, wherein the second end of a further anchor bolt extends through the second hole in the base plate, and wherein a further leveling nut is threaded onto the second end of the further anchor bolt below the base plate and a further top nut is threaded onto the second end of the further anchor bolt above the base plate.

16. The building of claim 10, wherein each bracket further comprises:

a first pair of holes including a first hole through the first upstanding plate and a second hole through the second upstanding plate, wherein the first and second holes of the first pair of holes are aligned about a centerline that is perpendicular to the first and second upstanding plates, and wherein the first and second holes are positioned to receive first and second ends of a bolt that extends through a first hole in the beam.

17. The building of claim 16, further comprising:

a plurality of bolts and nuts, wherein each bolt extends through the first hole through the first upstanding plate, the first hole in the beam, and the second hole through the second upstanding plate, and wherein each bolt has a distal end threadedly connected to one of the nuts.

18. The building of claim 16, wherein the bracket further comprises:

a second pair of holes including a third hole through the first upstanding plate and a fourth hole through the second upstanding plate, wherein the third and fourth holes of the second pair of holes are aligned about a centerline that is perpendicular to the first and second upstanding plates, and wherein the third and fourth holes are positioned to receive first and second ends of a second bolt that extends through a second hole in the beam.

19. The building of claim 18, further comprising:

a plurality of bolts and nuts, wherein, for each bracket, a first one of the bolts extends through the first hole through the first upstanding plate, the first hole in the beam, and the second hole through the second upstanding plate and has a distal end threadedly connected to one of the nuts, and wherein, for each bracket, a second one of the bolts extends through the third hole through the first upstanding plate, the second hole in the beam, and the fourth hole through the second upstanding plate and has a distal end threadedly connected to one of the nuts.

20. The building of claim 18, wherein the second pair of holes are horizontally spaced apart from the first pair of holes with the first gusset plate positioned between the first and second pairs of holes.

* * * * *